US006063557A

United States Patent [19]

Ly et al.

[11] Patent Number: 6,063,557

[45] Date of Patent: May 16, 2000

[54] COLOR PHOTOGRAPHIC SILVER HALIDE MATERIAL

[75] Inventors: Cuong Ly, Köln; Maria Nietgen, Leverkusen; Michael Missfeldt, Leichlingen; Heinz-Horst Teitscheid, Köln; Edgar Draber, Odenthal; Markus Geiger, Langenfeld, all of Germany

[73] Assignee: Agfa-Gevaert N.V., Belgium

[21] Appl. No.: 09/145,445

[22] Filed: Sep. 2, 1998

[30] Foreign Application Priority Data

Sep. 10, 1997 [DE] Germany ..... 197 39 639

[51] Int. Cl.[7] ..... G03C 1/08

[52] U.S. Cl. ..... 430/556; 430/583; 430/584; 430/585; 430/588; 430/590; 430/599; 430/604; 430/607; 430/608; 430/557

[58] Field of Search ..... 430/583, 584, 430/585, 588, 590, 599, 570, 604, 607, 608, 556.7

[56] References Cited

U.S. PATENT DOCUMENTS

| | | | |
|---|---|---|---|
| 4,885,233 | 12/1989 | Messing | 430/608 |
| 5,512,428 | 4/1996 | Missfeldt et al. | 430/583 |
| 5,582,960 | 12/1996 | Nielsen et al. | 430/583 |
| 5,919,613 | 7/1999 | Missfeldt | 430/583 |
| 5,922,526 | 7/1999 | Missfeldt | 430/583 |

*Primary Examiner*—Geraldine Letscher
*Attorney, Agent, or Firm*—Connolly Bove Lodge & Hutz LLP

[57] ABSTRACT

A color photographic silver halide material in which at least one of the blue-sensitive silver halide emulsions is doped with mercury and is spectrally sensitised with a sensitising dye of formula (I)

(I)

wherein $X_1$ and $X_2$, independently of each other, denote O, S, Se, NR,

R denotes alkyl or carboxyalkyl, $R_1$ and $R_2$ or $R_2$ and $R_3$ denote the remaining members for the completion of a phenanthro- or anthraazole ring, and the remaining $R_1$ or $R_3$ radical denotes a hydrogen atom, $R_4$ and $R_5$, independently of each other, denote a hydrogen atom, alkyl or aryl, or $R_4$ and $R_5$ jointly denote the remaining members of an unsubstituted or substituted benzazole, naphthazole, phenanthro- or anthraazole, $S_1$ and $S_2$, independently of each other, denote alkyl, sulphoallyl or carboxyalkyl, and $M^+$ denotes a cation which is possibly necessary for charge equalisation, is distinguished by an improved latent image stability.

6 Claims, No Drawings

COLOR PHOTOGRAPHIC SILVER HALIDE MATERIAL

This invention relates to a colour photographic silver halide material which is distinguished by high sensitivity and by improved latent image stability, particularly by an improved short-term latent image stability.

Exposed colour photographic silver halide material should provide sensitometric results which are as constant as possible during processing, irrespective of whether there are only a few seconds or many months between exposure and processing. For colour paper, this period of time is reduced to between a few seconds to several days. This property is called latent image stability.

Previous colour photographic silver halide materials comprising at least one blue-sensitive silver halide emulsion layer containing at least one yellow coupler, at least one green-sensitive silver halide emulsion layer containing at least one magenta coupler, and at least one red-sensitive silver halide emulsion layer containing at least one cyan coupler still give unsatisfactory results with regard to this property.

The object of the present invention was therefore to improve the latent image stability. A further object was to improve the sensitivity of the material. Surprisingly, this has been achieved for the material described above by the joint use of defined sensitising dyes and by doping at least one blue-sensitive silver halide emulsion layer with mercury.

The present invention therefore relates to a colour photographic silver halide material of the aforementioned type, which is characterised in that at least one of the blue-sensitive silver halide emulsions is doped with mercury and is spectrally sensitised with a sensitising dye of formula (I):

(I)

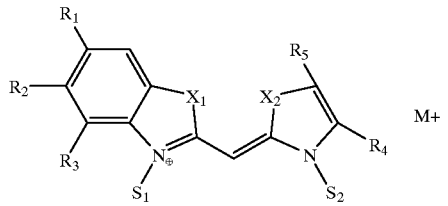

wherein $X_1$ and $X_2$, independently of each other, denote O, S, Se, NR,

R denotes alkyl or carboxyalkyl, $R_1$ and $R_2$ or $R_2$ and $R_3$ denote the remaining members for the completion of aphenanthro- or anthraazole ring, and the remaining $R_1$ or $R_3$ radical denotes a hydrogen atom, $R_4$ and $R_5$, independently of each other, denote a hydrogen atom, alkyl or aryl, or $R_4$ and $R_5$ jointly denote the remaining members of an unsubstituted or substituted benzazole, naphthazole, phenanthro- or anthraazole, $S_1$ and $S_2$, independently of each other, denote alkyl, sulphoalkyl or carboxyalkyl, and $M^+$ denotes a cation which is possibly necessary for charge equalisation.

Colour photographic silver halide materials are preferred in which the silver halide emulsions consist of at least 95 mole % of AgCl, particularly those which contain at most 4 mole % AgI, preferably less than 0.5 mole % AgI.

The materials preferably contain at least one yellow coupler of formula (II)

(II)

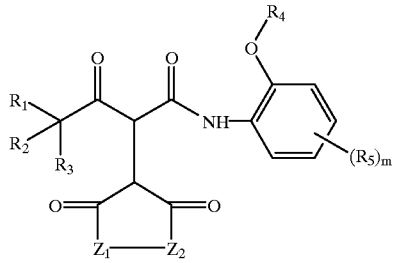

in which $R_1$, $R_2$, $R_3$, independently of each other, denote alkyl, or $R_2$ and $R_3$ jointly form a three- to six-membered ring;

$R_4$ denotes alkyl, cycloalkyl or aryl;

$R_5$ denotes halogen, alkyl, alkoxy, aryloxy, alkoxycarbonyl, alkylsulphonyl, alkylcarbamoyl, arylcarbamoyl, alkylsulphamoyl or arylsulphamoyl;

m is 0, 1, 2or3;

$Z_1$ denotes —O— or —$NR_6$—;

$Z_2$ denotes —$NR_7$— or —$C(R_8)R_9$—; and $R_6$, $R_7$, $R_8$ and $R_9$, independently of each other, denote hydrogen or a substituent.

By the expression "doping with mercury", it is to be understood that mercury compounds are added before precipitation is complete, so that the mercury compound, depending on the time of its addition, is situated substantially in the interior of the silver halide grains and is not simply situated on the surface—as in ripening. In order to achieve this, water-soluble mercury compounds are added to at least one of the precipitation solutions.

Suitable water-soluble salts of mercury correspond either to formula (III) or (IV):

$Hg(X_1)_2$ (III), $Hg(X_2)$ (IV), wherein $X_1$ denotes a monovalent anion and $X_2$ denotes a divalent anion, for example fluoride, chloride, bromide, iodide, nitrate, cyanide, acetate, oxalate or sulphate.

The mercury salts are preferably used as an aqueous solution.

The mercury compound is preferably used in an amount of 1.0 to 30 $\mu$moles/mole of the respective silver halide The colour photograhic silver halide material preferably contains, in all the light-sensitive layers, a silver halide emulsion which consists of at least 95 mole % AgCl and contains less than 4 mole % AgI, and which in particular is free from silver iodide.

Ripening of the emulsions is effected with both gold compounds and sulphur and/or selenium compounds.

The emulsions according to the invention can be stabilised in the known manner with acidic NH or SH compounds. The stabilisers are preferably added after ripening and are selected so that they do not displace the sensitising dye or sensitising dyes from the emulsion grains of the silver chloride emulsion, and moreover so that they do not impede the bleaching of the image silver in the course of processing.

Ripening with sulphur is preferably effected using sodium thiosulphate as the ripening agent, although thioureas, isothiocyanates or thiophosphates can also be used as sulphur ripening agents.

Ripening with selenium is preferably effected using selenoureas, which are at least tri-substituted, with heterocyclic selenones which cannot be deprotonated into a selenolation, or with phosphane selenides, preferably with triarylphosphane selenides.

Ripening with gold is preferably effected using gold(III) chloride or a tetra-chloroaurate salt which is reduced to a gold(I) compound in the course of ripening.

Sulphur and/or selenium ripening on the one hand and gold ripening on the other hand can be effected jointly or in succession.

In addition, the emulsions may also contain other transition metal compounds of Group VIII of the periodic table in the form of dopants, which are added in order to achieve the desired gradation or to obtain the desired latent image behaviour, or to achieve a behaviour substantially free from reciprocity errors during or after the precipitation of the silver chloride. Examples include salts of rhodium(III) or iridium(III). The emulsions can also contain hexacyanoferrate(II) as a dopant.

In addition, the emulsions may also contain palladium(II) compounds, particularly tetrachloropalladates(II), which should improve their long-term stability.

In order to reduce fogging, the emulsions may also contain certain isothiazolone or isoselenazolone compounds, or disulphides or diselenides.

Chemical ripening, by sulphur or selenium compounds and gold, and spectral sensitisation can be effected separately or in one step.

The colour photographic silver halide materials which are particularly preferred are those which contain, as magenta couplers, pyrazolotriazole magenta couplers of formula (V)

(V)

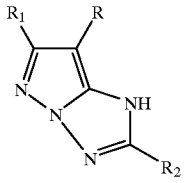

wherein

R denotes H or a group which is split off under the conditions of chromogenic development, $R_1$ denotes alkyl, which is optionally substituted, and $R_2$ denotes $R_1$ or aryl, wherein the sum of all the C atoms of the $R_1$ and $R_2$ radicals in a coupler molecule is at least 12.

The colour photographic silver halide material is preferably a copier material.

Photographic copier materials consist of a support on which at least one light-sensitive silver halide emulsion layer is deposited. Thin films and foils are particularly suitable as supports. A review of support materials and of the auxiliary layers which are deposited on the front and back thereof is given in Research Disclosure 37254, Part 1 (1995), page 285.

Colour photographic copier materials usually contain at least one red-sensitive, at least one green-sensitive and at least one blue-sensitive silver halide emulsion layer, and optionally contain intermediate layers and protective layers also.

Depending on the type of photographic material, these layers may be arranged differently. This will be illustrated using a colour negative paper as an example:

Colour photographic paper, which as a rule is considerably less sensitive to light than a colour photographic film is, usually comprises, in the following sequence on their support: a blue-sensitive, yellow-coupling silver halide emulsion layer, a green-sensitive, magenta-coupling silver halide emulsion layer and a red-sensitive, cyan-coupling silver halide emulsion layer. The yellow filter layer may be omitted.

The essential constituents of the photographic emulsion layers are binders, silver halide grains and colour couplers.

Information on suitable binders is given in Research Disclosure 37254, Part 2 (1995), page 286.

Information on suitable silver halide emulsions, their production, ripening, stabilisation and spectral sensitisation, including suitable spectral sensitisers, is given in Research Disclosure 37254, Part 3 (1995), page 286, and in Research Disclosure 37038, Part XV (1995), page 89.

Information on colour couplers is to be found in Research Disclosure 37254, Part 4 (1995), page 288, and in Research Disclosure 37038, Part II (1995), page 80. The maximum absorption of the dyes formed from the couplers and from the colour developer oxidation product preferably falls within the following ranges: yellow couplers 430 to 460 nm, magenta couplers 540 to 560 nm, cyan couplers 630 to 700 nm.

The colour couplers, which are mostly hydrophobic, and other hydrophobic constituents of the layers also, are usually dissolved or dispersed in high-boiling organic solvents. These solutions or dispersions are then emulsified in an aqueous binder solution (usually a gelatine solution), and after the layers have been dried are present as fine droplets (0.05 to 0.8 $\mu$m diameter) in the layers.

Suitable high-boiling organic solvents, methods of introduction into the layers of a photographic material, and other methods of introducing chemical compounds into photographic layers, are described in Research Disclosure 37254, Part 6 (1995), page 292.

The light-insensitive intermediate layers which are generally disposed between layers of different spectral sensitivity may contain media which prevent the unwanted diffusion of developer oxidation products from one light-sensitive layer into another light-sensitive layer which has a different spectral sensitivity.

Suitable compounds (white couplers, scavengers or DOP scavengers) are described in Research Disclosure 37254, Part 7 (1995), page 292, and in Research Disclosure 37038, Part III (1995), page 84.

The photographic material may additionally contain compounds which absorb UV light, brighteners, spreaders, filter dyes, formalin scavengers, light stabilisers, anti-oxidants, $D_{Min}$ dyes, additives for improving the dye-, coupler- and whiteness stability and for reduction of colour fogging, plasticisers (latices), biocides and other substances.

Suitable compounds are given in Research Disclosure 37254, Part 8 (1995), page 292, and in Research Disclosure 37038, Parts IV, V, VI, VII, X, XI and XIII (1995), pages 84 et seq.

The layers of colour photographic materials are usually hardened, i.e. the binder used, preferably gelatine, is crosslinked by suitable chemical methods.

Instantaneous or rapid hardeners are usually used, wherein the expression "instantaneous or rapid hardeners" is to be understood to mean compounds which crosslink gelatine so that directly after it has been coated, or no later than a few days after it has been coated, hardening is complete to such an extent that no further change in the sensitometry and swelling of the composite layer occurs due to the crosslinking reaction. The term "swelling" is to be understood to mean the difference between the wet film thickness and the dry film thickness during the processing of the material.

Suitable instantaneous and rapid hardener substances are described in Research Disclosure 37254, Part 9 (1995), page 294, and in Research Disclosure 37038, Part XII (1995), page 86.

After image-by-image exposure, colour photographic materials are processed by different methods corresponding to their character. Details on the procedures used and the chemicals required therefor are published in Research Disclosure 37254, Part 10 (1995), page 294, and in Research Disclosure 37038, Parts XVI to XXIII (1995), page 95 et seq., together with examples of materials.

Examples of couplers of formula (V) include:

M-1

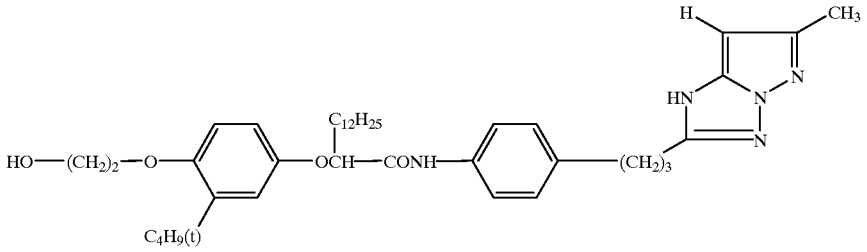

M-2

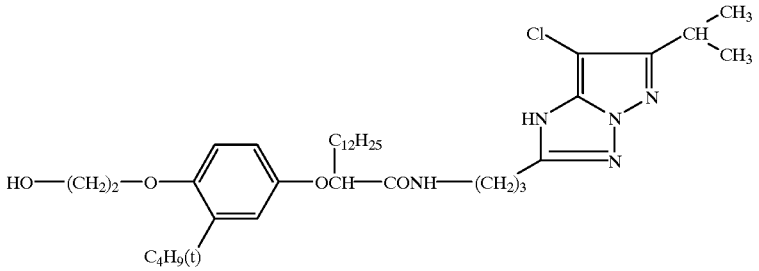

M-3

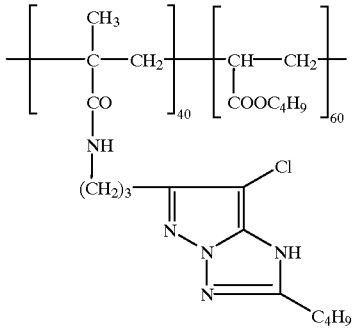

M-4

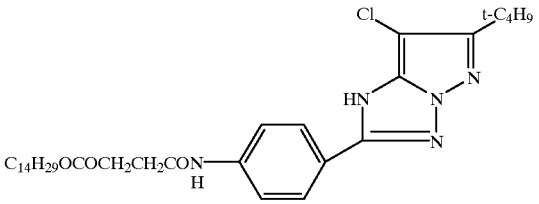

M-5

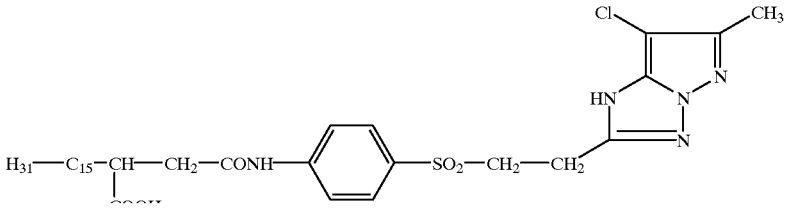

-continued
M-6
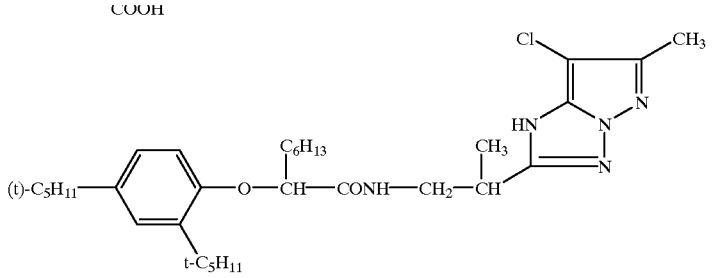
M-7
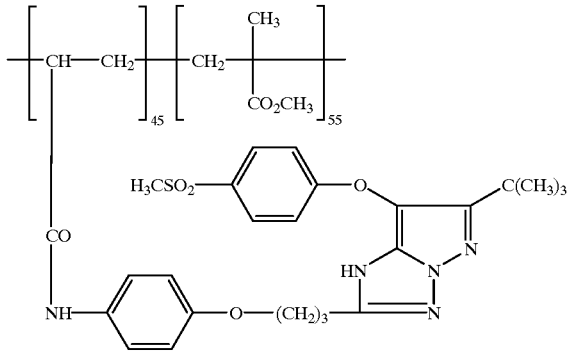
M-8
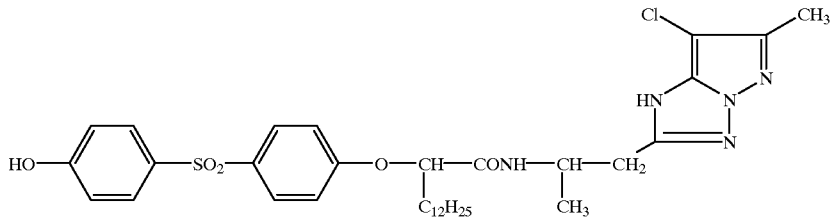
M-9
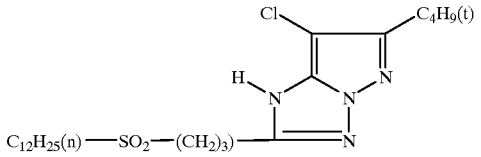
M-10
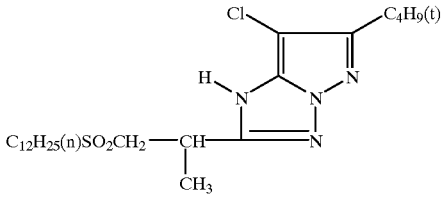
M-11
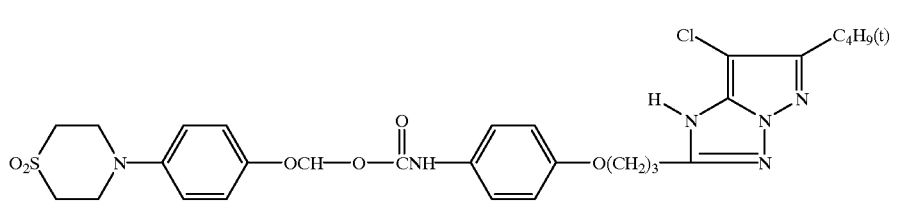

-continued

M-12

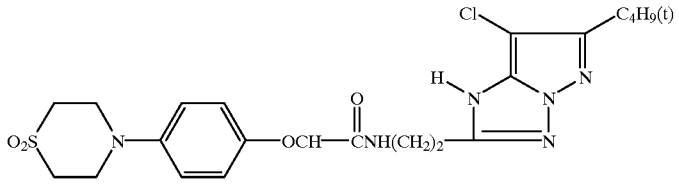

M-13

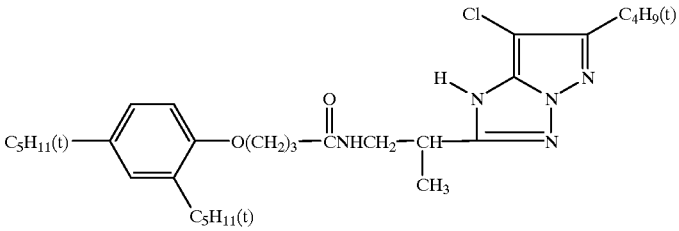

Examples of suitable sensitising dyes of formula (I) correspond to formulae (Ia), (Ib), (Ic), (Id), (Ie) and (If), and include:

(Ia)

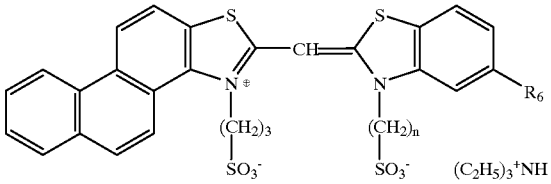

| Nr. | n | $R_6$ |
|---|---|---|
| I-1 | 3 | Cl |
| I-2 | 3 | F |
| I-3 | 3 | 1-pyrrolyl |
| I-4 | 3 | 2-thienyl |
| I-5 | 3 | 1-indolyl |
| I-6 | 3 | H |
| I-7 | 3 | 3-thienyl |
| I-8 | 3 | 3-furyl |
| I-9 | 3 | 2-furyl |
| I-10 | 4 | Cl |

(Ib)

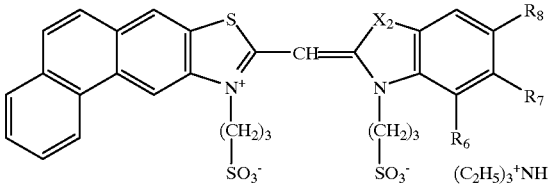

| Nr. | $X_2$ | $R_6$ | $R_7$ | $R_8$ |
|---|---|---|---|---|
| I-11 | S | H | Cl | H |
| I-12 | S | benzo | | H |
| I-13 | S | 1,2-naphtho | | H |
| I-14 | S | H | 1,2-naphtho | |
| I-15 | S | H | F | H |
| I-16 | O | H | Cl | H |
| I-17 | O | H | phenyl | H |

-continued (Ib)

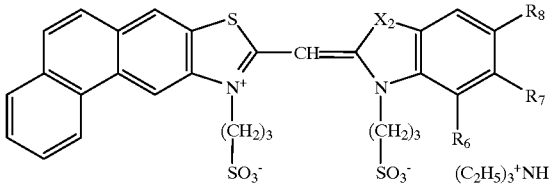

| Nr. | $X_2$ | $R_6$ | $R_7$ | $R_8$ |
|---|---|---|---|---|
| I-18 | O | 1,2-naphtho | | H |
| I-19 | O | H | 1,2-naphtho | |
| I-20 | O | benzo | | H |
| I-21 | S | H | H | H |
| I-22 | S | H | phenyl | H |
| I-23 | S | H | Br | H |
| I-24 | S | H | $OCH_3$ | H |
| I-25 | O | H | benzo | |
| I-26 | S | H | benzo | |
| I-27 | S | H | 1-pyrrolyl | H |
| I-28 | S | H | 2-thienyl | H |
| I-29 | S | H | 1-indolyl | H |
| I-30 | S | H | 3-thienyl | H |
| I-31 | S | H | 3-furyl | H |
| I-32 | S | H | 2-furyl | H |

(Ic)

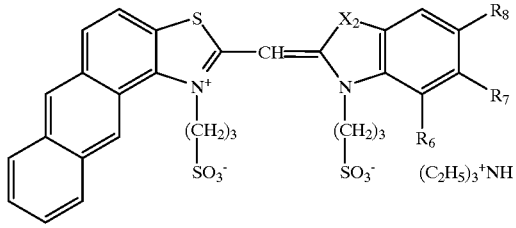

| Nr. | $X_2$ | $R_6$ | $R_7$ | $R_8$ |
|---|---|---|---|---|
| I-33 | S | H | Cl | H |
| I-34 | S | H | benzo | |
| I-35 | S | benzo | | H |
| I-36 | S | 2,3-naphtho | | H |

-continued (Ic)

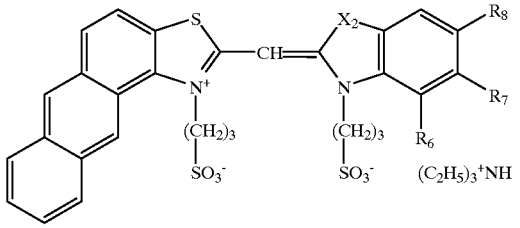

| Nr. | $X_2$ | $R_6$ | $R_7$ | $R_8$ |
|---|---|---|---|---|
| I-37 | S | 1,2-naphtho | | H |
| I-38 | S | H | 1,2-naphtho | |
| I-39 | S | H | 2-thienyl | H |
| I-40 | S | H | 3-thienyl | H |
| I-41 | S | H | 1-pyrrolyl | H |
| I-42 | S | H | 1-indolyl | H |
| I-43 | S | H | H | H |
| I-44 | S | H | 2-furyl | H |
| I-45 | S | H | 3-furyl | H |
| I-46 | O | H | phenyl | H |
| I-47 | O | H | Cl | H |
| I-48 | O | H | benzo | |
| I-49 | O | H | 1,2-naphtho | |
| I-50 | O | 1,2-naphtho | | H |
| I-51 | O | 2,3-naphtho | | H |
| I-52 | O | H | Cl | $CH_3$ |

(Id)

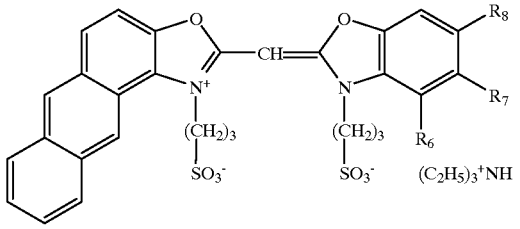

| Nr. | $R_6$ | $R_7$ | $R_8$ |
|---|---|---|---|
| I-53 | 2,3-naphtho | | H |
| I-54 | 1,2-naphtho | | H |
| I-55 | H | 1,2-naphtho | |
| I-56 | benzo | | H |

(Ie)

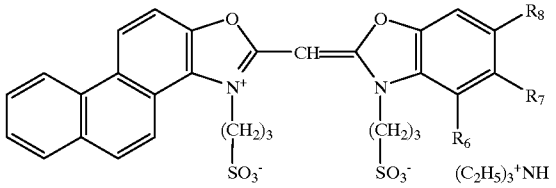

| Nr. | $R_6$ | $R_7$ | $R_8$ |
|---|---|---|---|
| I-57 | 1,2-naphtho | | H |
| I-58 | benzo | | H |
| I-59 | H | phenyl | H |

(If)

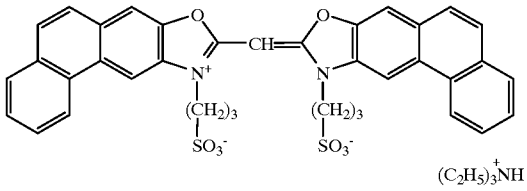

"Naphtho" radicals can be linked differently to the azole radical;

1,2-naphtho for $R_6$, $R_7$ results in the following ring system:

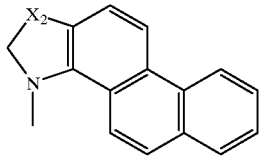

2,3-naphtho for $R_6$, $R_7$ results in the following ring system:

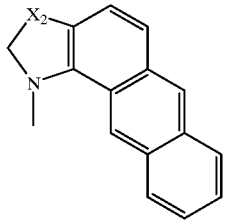

1,2-naphtho for $R_7$, $R_8$ results in the following ring system:

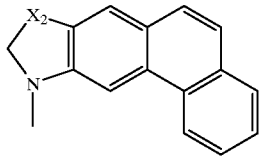

Examples of yellow couplers of formula II according to the invention include:

Y-1
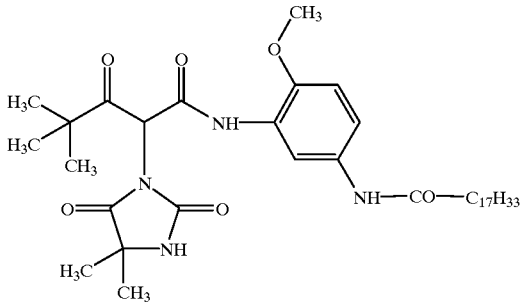
Y-2
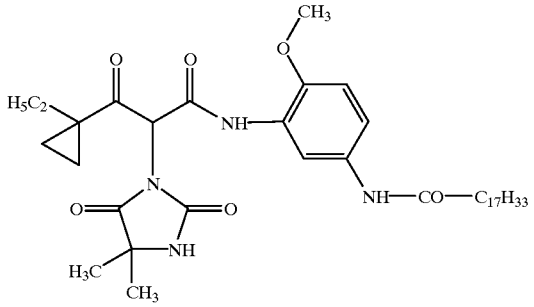
Y-3
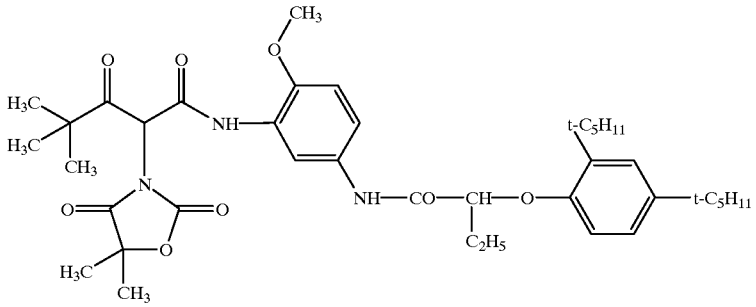
Y-4
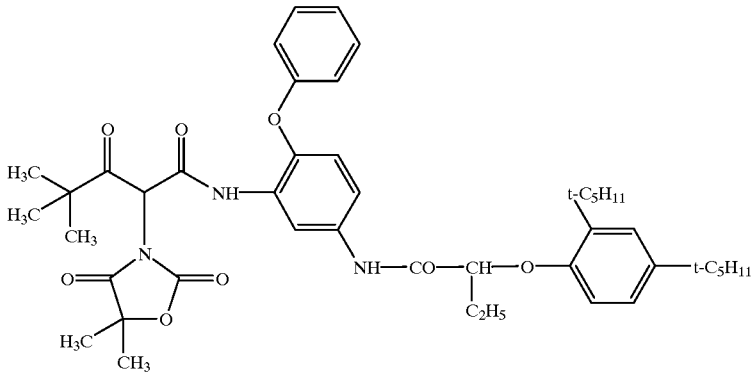

-continued
Y-5
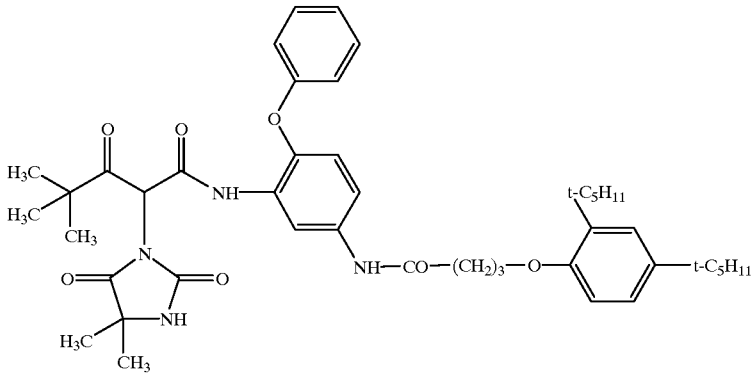
Y-6
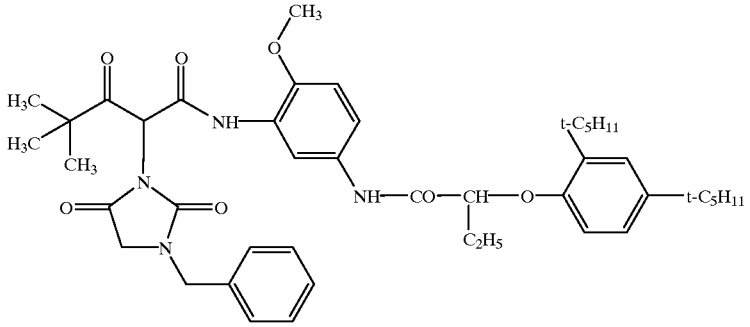
Y-7
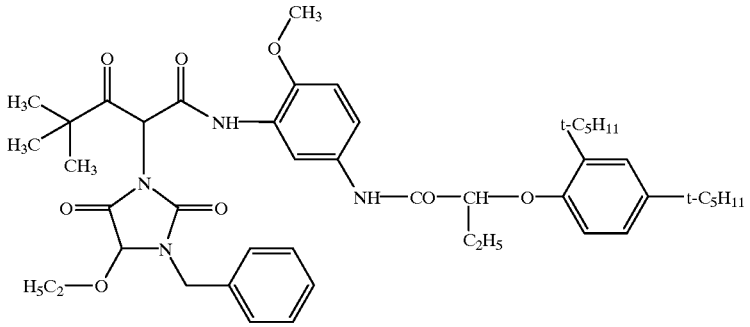
Y-8
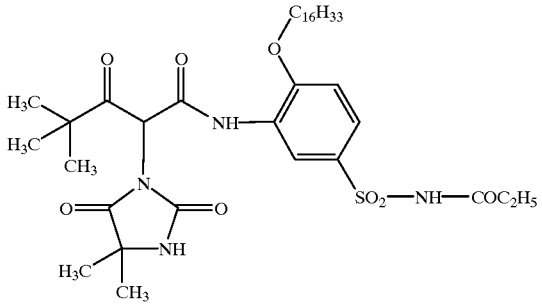

-continued
Y-9
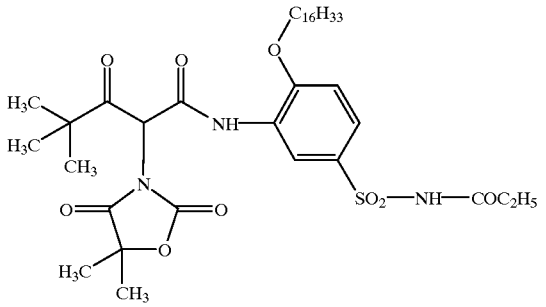
Y-10
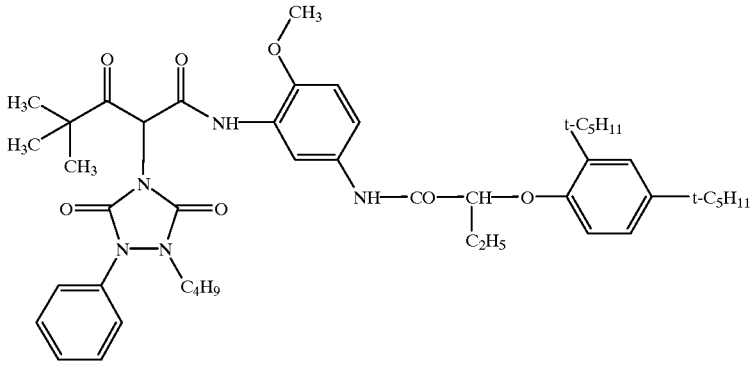
Y-11
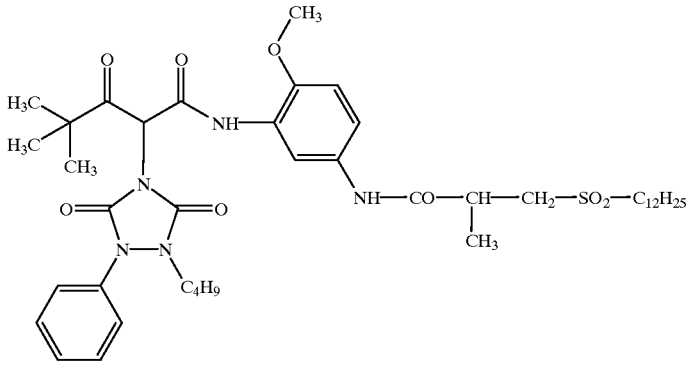
Y-12
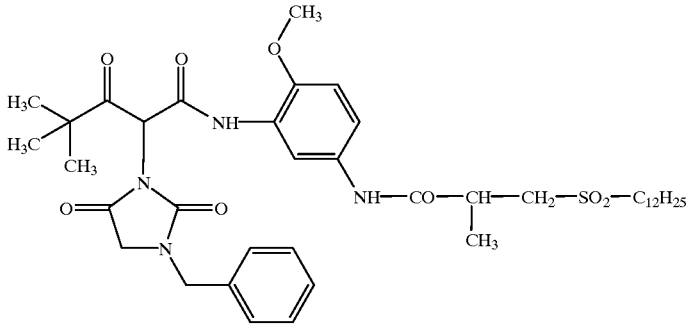

-continued
Y-13
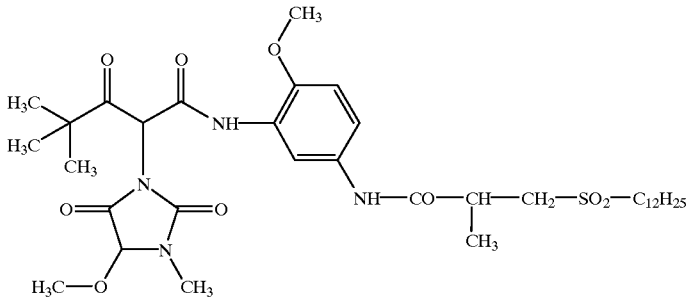
Y-14
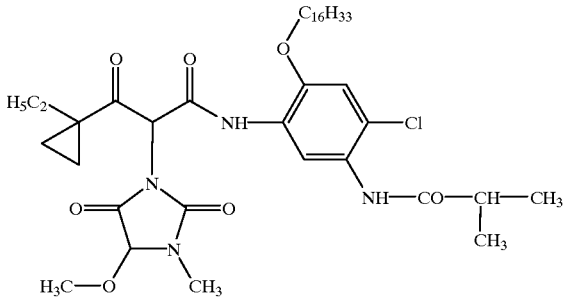
Y-15
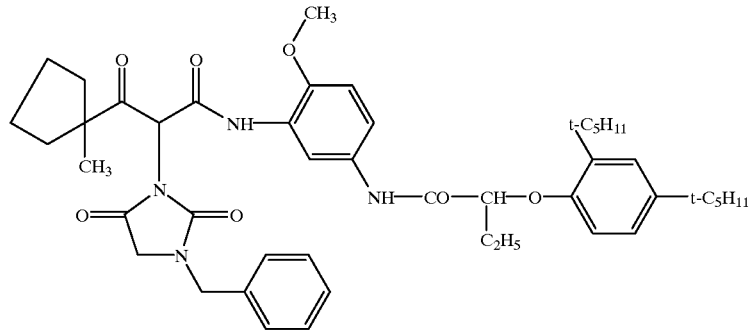
Y-16
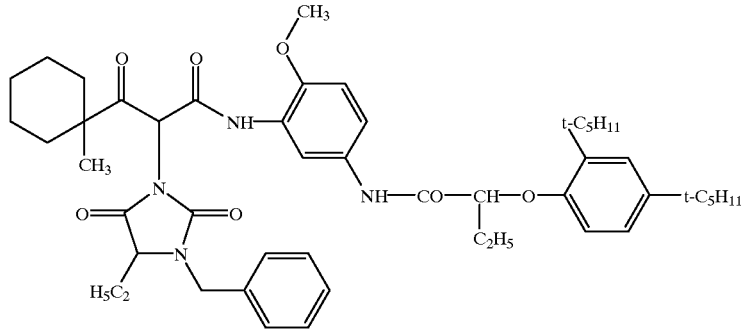

-continued
Y-17
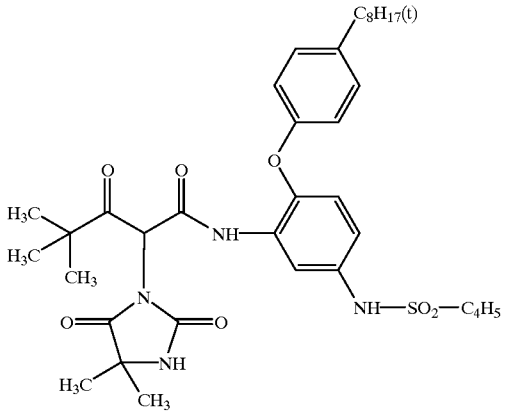
Y-18
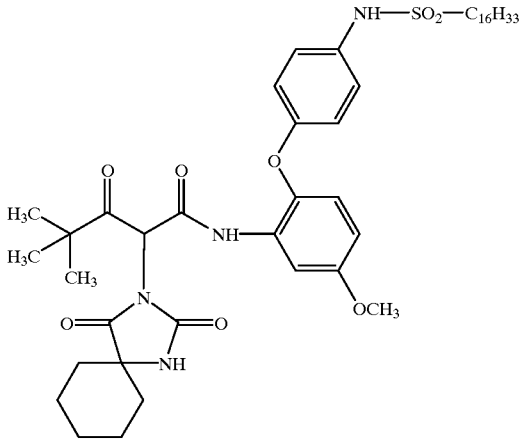
Y-19
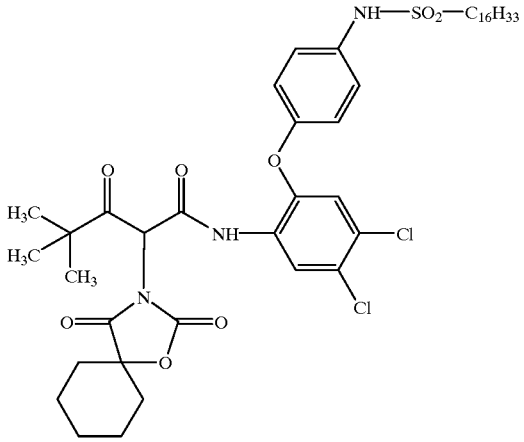
Y-20
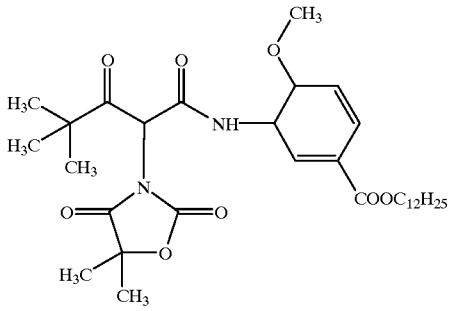

-continued
Y-21
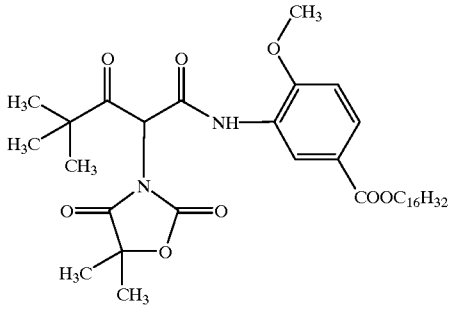
Y-22
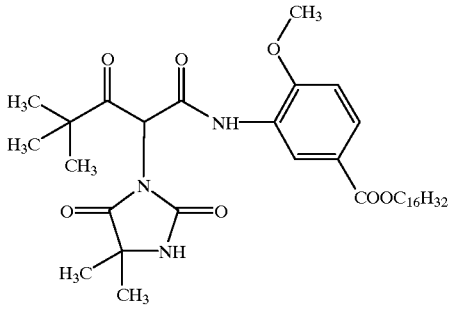
Y-23
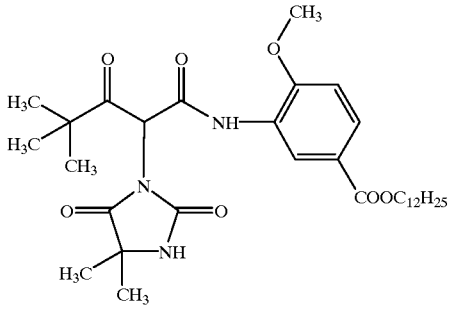
Y-24
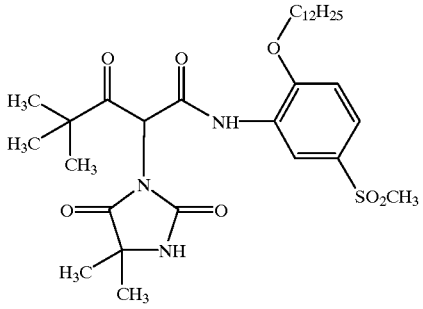
Y-25
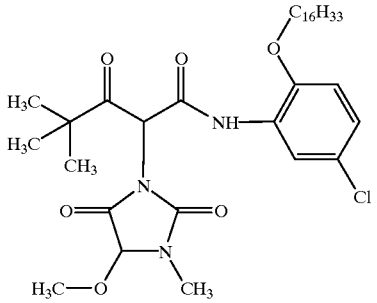

-continued
Y-26
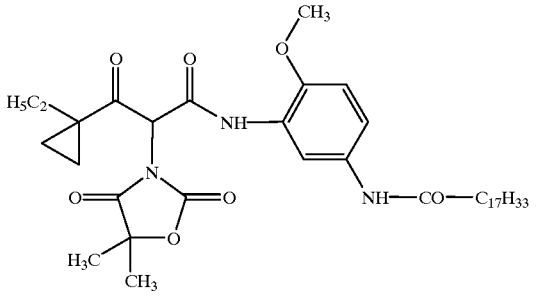
Y-27
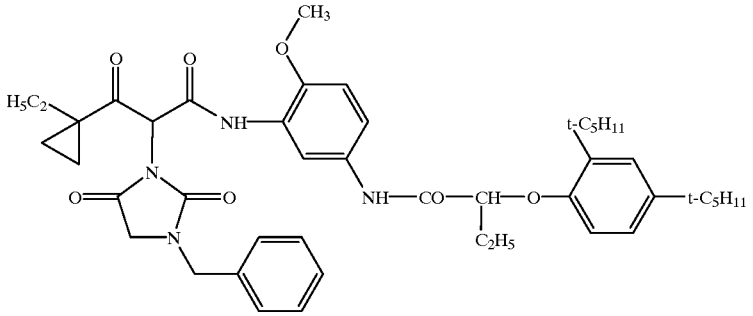
Y-28
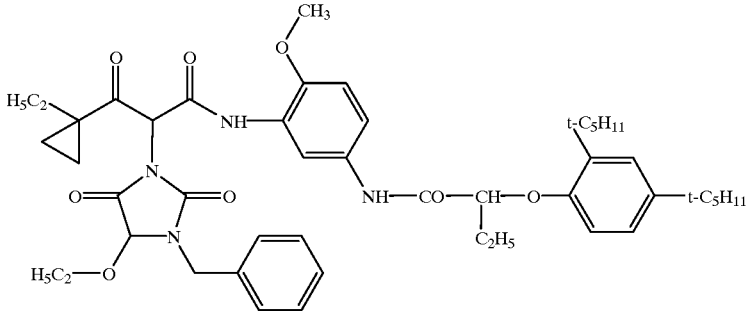
Y-29
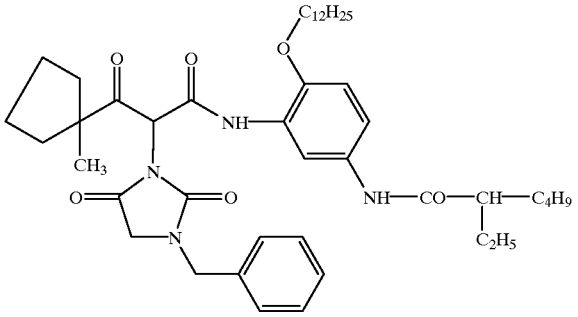

-continued
Y-30
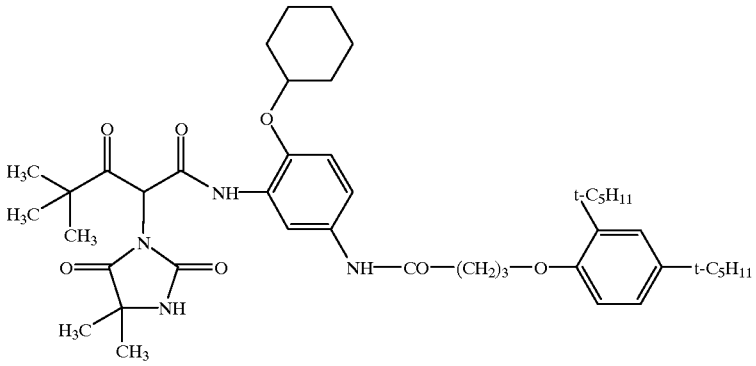
Y-31
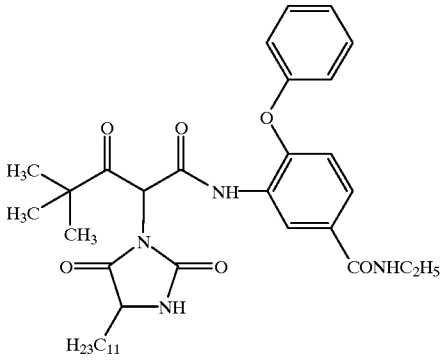
Y-32
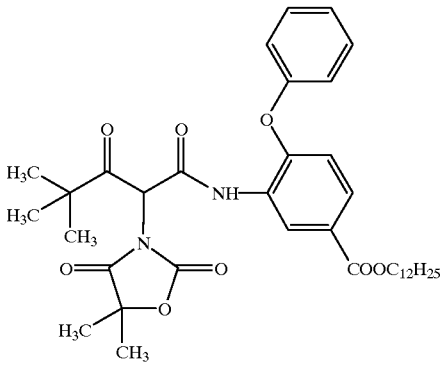
Y-33
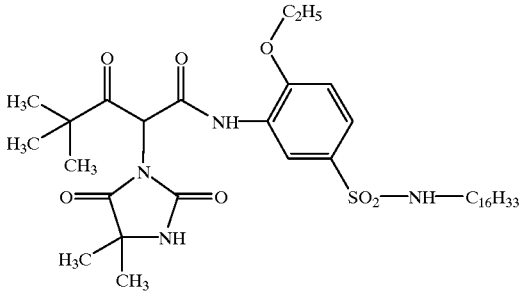

-continued
Y-34
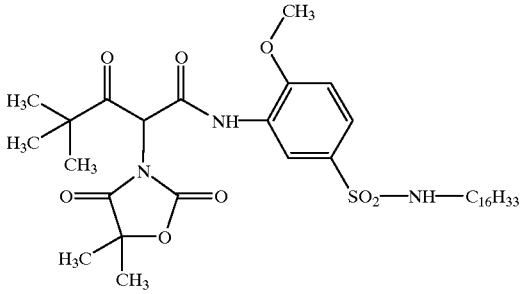
Y-35
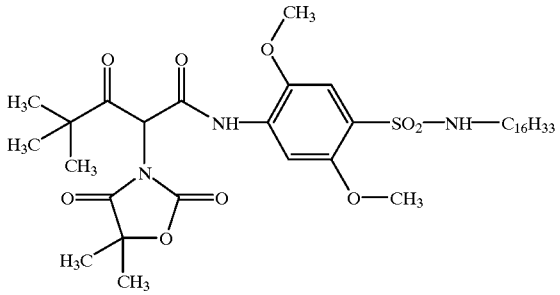
Y-36
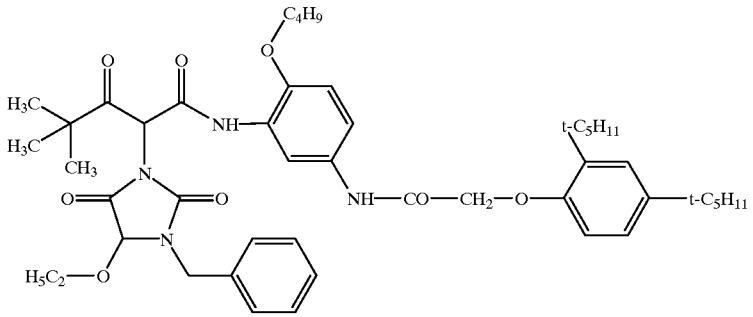
Y-37
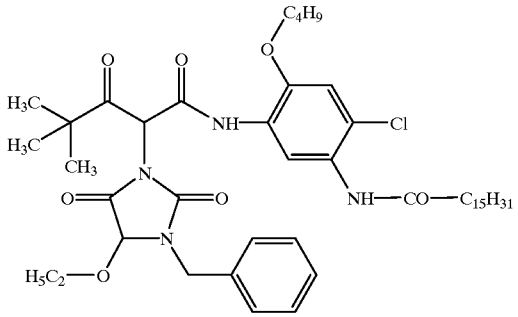
Y-38
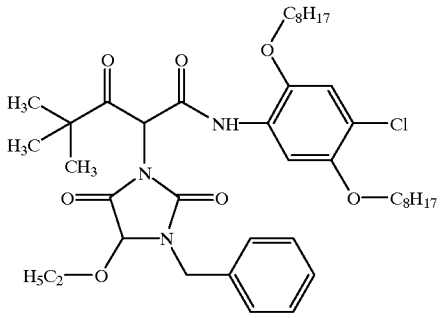

-continued
Y-39
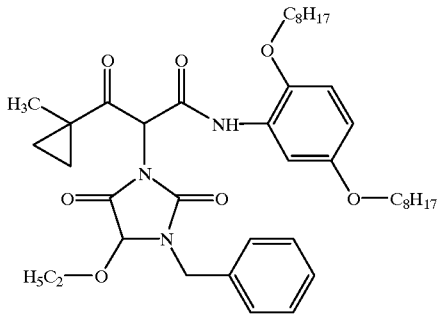
Y-40
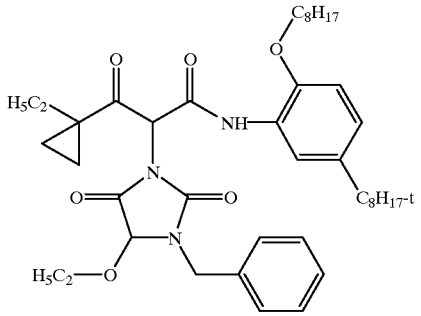
Y-41
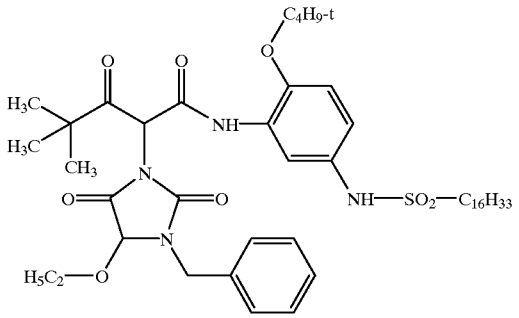
Y-42
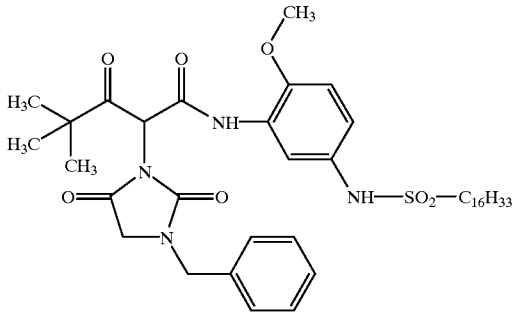
Y-43
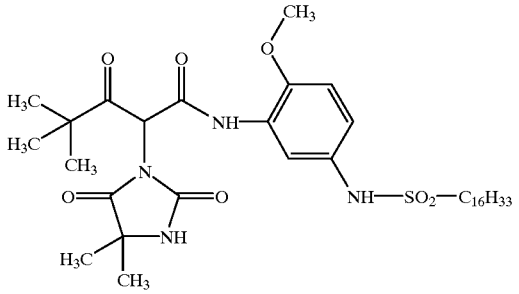

-continued
Y-44
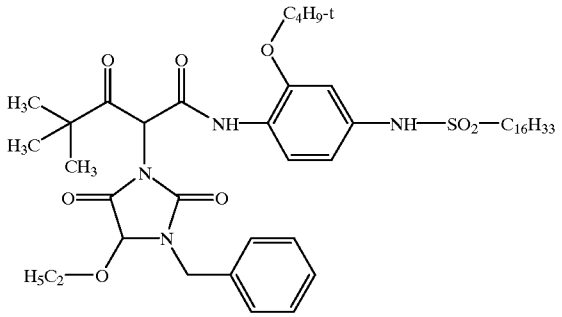
Y-45
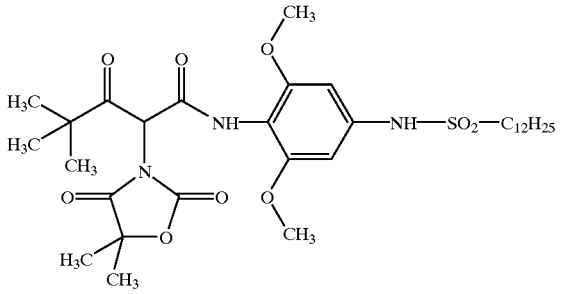
Y-46
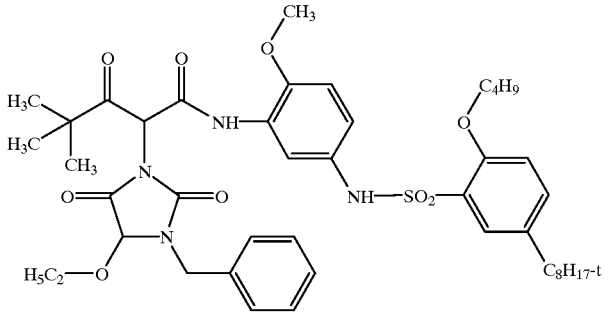
Y-47
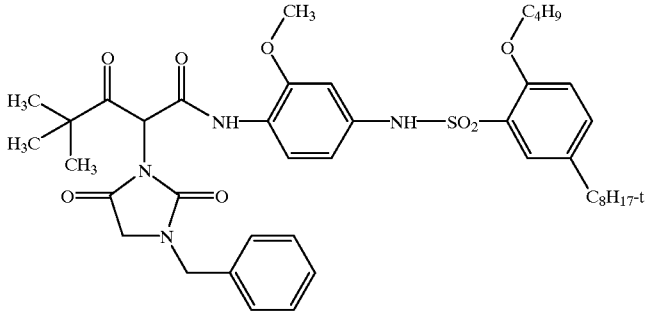
Y-48
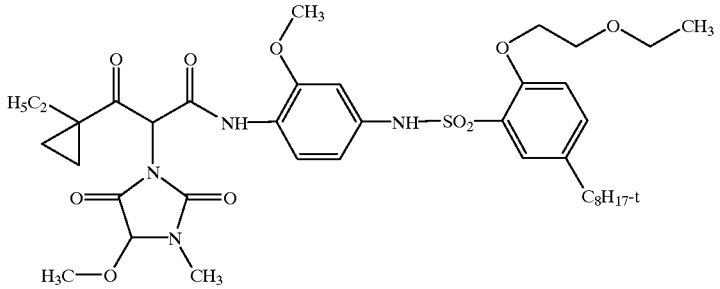

-continued

Y-49

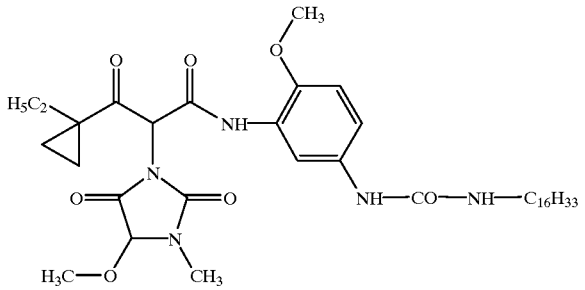

Y-50

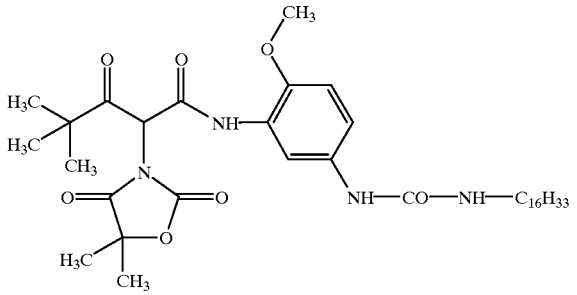

Production of the Silver Halide Emulsion

A: Blue-Sensitive Emulsions

Emulsion A-1

The following solutions were each made up with demineralised water:

| | | |
|---|---|---|
| solution 11 | 1100 g | water |
| | 140 g | gelatine |
| solution 12 | 1860 g | water |
| | 360 g | NaCl |
| solution 13 | 1800 g | water |
| | 1000 g | $AgNO_3$ |

Solutions 12 and 13 were added simultaneously over 300 minutes at 50° C, with intensive strirring and at a pAG of 7.7, to solution 11. A silver chloride emulsion with an average particle diameter of 0.85 $\mu$m was obtained. The gelatine/$AgNO_3$ weight ratio was 0.14. The emulsion was subjected to ultrafiltration, washed and redispersed with an amount of gelatine such that the gelatine/$AgNO_3$ weight ratio was 0.56. The emulsion was ripened at a pH of 5.3 and at a temperature of 50° C., using the optimum amount of gold(III) chloride and the optimum amount of $Na_2S_2O_3$. After chemical ripening, the emulsion was spectrally sensitised at 50° C. with 1.4 g of compound (AI)/kg $AgNO_3$, was stabilised with 0.5 g of compound (AII)/kg $AgNO_3$, was subsequently treated with 0.6 mole % Kbr (with respect to silver nitrate).

AI

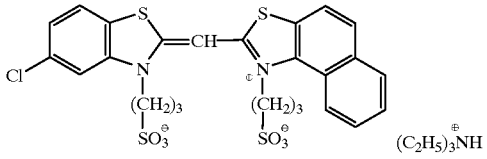

AII

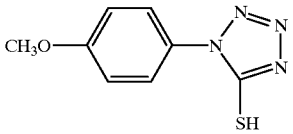

Emulsion A-2: the procedure was as for emulsion A-1, except that after ripening at 50° C. the emulsion was spectrally sensitised with 1.51 g of compound I-1/kg $AgNO_3$ instead of with 1.4 g of compound A-1.

Emulsion A-3: the procedure was as for emulsion A-1, except that 10.5 mg $HgSO_4$ was added to solution 11. The emulsion contained 6 emotes $Hg^{2+}$/mole $AgNO_3$.

Emulsion A-4: the procedure was as for emulsion A-3, except that after ripening at 50° C. the emulsion was spectrally sensitised with 1.51 g of compound I-1/kg Ag instead of with 1.4 g B: Green-Sensitive Emulsions Emulsion B-1

The following solutions were each made up with demineralised water:

| | | |
|---|---|---|
| solution 21 | 1000 g | water |
| | 140 g | gelatine |
| solution 22 | 1650 g | water |

-continued

| | | |
|---|---|---|
| | 360 g | NaCl |
| | 0.11 mg | $Na_3RhCl_6$ |
| solutions 23 | 1600 g | water |
| | 1000 g | $AgNO_3$ |

Solutions 22 and 23 were added simultaneously over 105 minutes at 60° C., with intensive stirring and at a pAg of 7.7, to solution 21. A silver chloride emulsion with an average particle diameter of 0.40 $\mu$m was obtained. The gelatine/$AgNO_3$ weight ratio was 0.14. The emulsion was subjected to ultrafilration, washed and redispersed with an amount of gelatine such that the gelatine/$AgNO_3$ weight ratio was 0.56.

The emulsion was ripened at a temperature of 60° C. and at a pH of 5.3 for 3 hours, using the optimum amount of gold(III) chloride and the optimum amount of $Na_2S_2O_3$. After chemical ripening, the emulsion was spectrally sensitised at 50° C. with 2 g of compound (BI)/kg $AgNO_3$, and was stabilised with 1.0 g of compound (BII)/kg $AgNO_3$. 0.3 mole KBr/mole $AgNO_3$ was subsequently added.

B-I

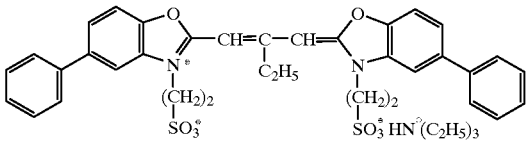

B-II

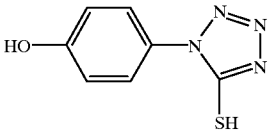

C: Red-Sensitive Emulsions

Emulsion C-1

This was produced analogously to B-1.

After chemical ripening, the emulsion was spectrally sensitised at 40° C. with 150 mg of compound (CI)/kg $AgNO_3$, and was stabilised with 2 g of compound (CII)/kg $AgNO_3$. 0.3 moles KBr/mole $AgNO_3$ were subsequently added.

C-I

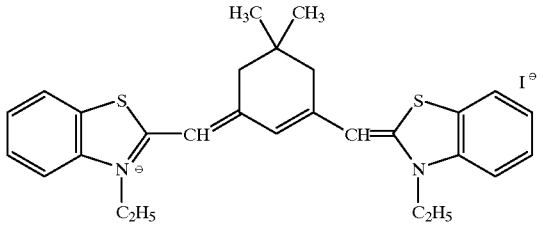

C-II

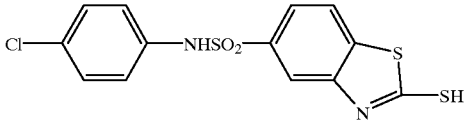

Layer Structure 1

A colour photographic recording material suitable for a rapid processing procedure was produced by depositing the following layers in the given sequence on a support comprising paper coated on both sides with polyethylene. The quantitative data are given with respect to 1 $m^2$ in each case. The corresponding amounts of $AgNO_3$ are quoted for silver halide deposition.

| | |
|---|---|
| Layer 1: | (substrate layer) |
| | 0.2 g gelatine |
| Layer 2: | (blue-sensitive layer) |
| | blue-sensitive silver halide emulsion A-1, comprising 0.40 g $AgNO_3$, |
| | with |
| | 0.96 g gelatine |
| | 0.55 g yellow coupler Y-1 |
| | 0.21 g tricresyl phosphate (TCP) |
| | 0.11 g dye stabiliser ST-1 |
| Layer 3: | (intermediate layer) |
| | 1.02 g gelatine |
| | 0.05 g 2,5-di-tert.-octylhydroquinone |
| | 0.10 g TCP |
| | 0.05 g compound SC-1 |
| Layer 4: | (green-sensitive layer) |
| | green-sensitive silver halide emulsion B-1, comprising 0.30 g $AgNO_3$, |
| | with |
| | 0.66 g gelatine |
| | 0.20 g magenta coupler PP-1 |
| | 0.10 g compound SC-1 |
| | 0.25 g coupler solvent K-1 |
| | 0.05 mg dye stabiliser ST-2 |
| Layer 5 | (intermediate layer) |
| | 1.02 g gelatine |
| | 0.48 g UV absorber UV-1 |
| | 0.08 g UV absorber UV-2 |
| | 0.28 g coupler solvent K-2 |
| | 0.025 g 2,5-di-tert.-octylhydroquinone |
| | 0.025 g compound SC-1 |
| | 0.05 g TCP |
| Layer 6 | (red-sensitive layer) |
| | red-sensitive silver halide emulsion C-1, comprising 0.29 g $AgNO_3$, |
| | with |
| | 0.85 g gelatine |
| | 0.41 g cyan coupler C-1 |
| | 0.41 g TCP |
| Layer 7 | (protective layer) |
| | 0.33 g gelatine |
| | 0.15 g UV absorber UV-1 |
| | 0.03 g UV absorber UV-2 |
| | 0.09 g coupler solvent K-2 |
| Layer 8 | (protective layer) |
| | 0.92 g gelatine |
| | 0.34 g hardener H-1 |

The following compounds were used in sample 1:
Y-1
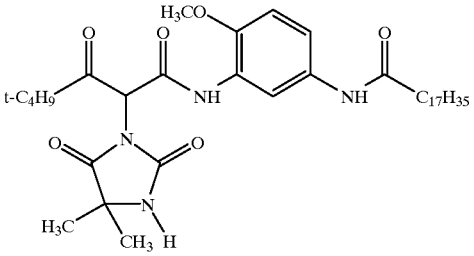
PP-1
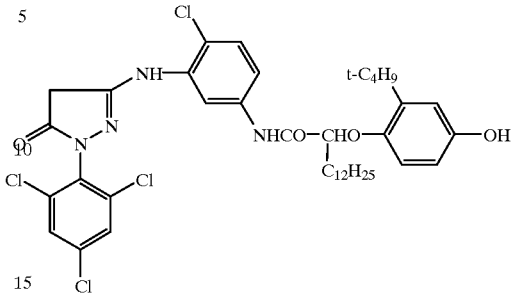
C-1
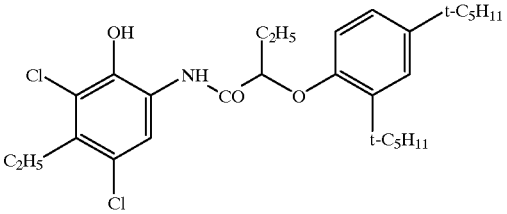
SC-1
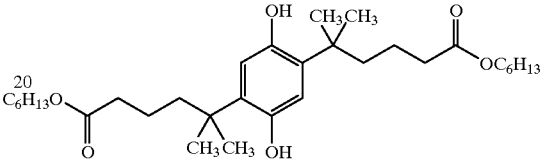
UV-1
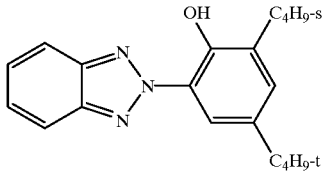
UV-2
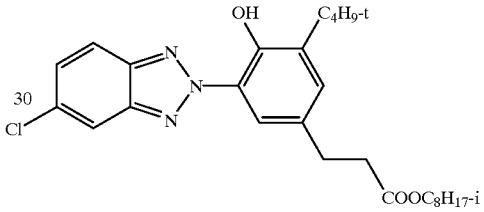
H-1
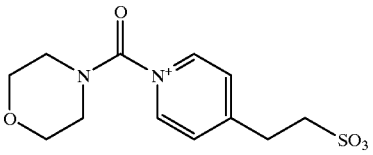
K-1
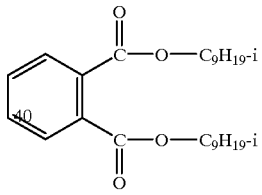
K-2
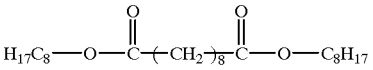
ST-1
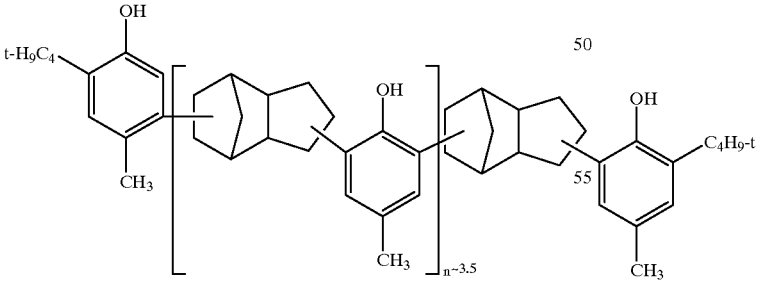
ST-2
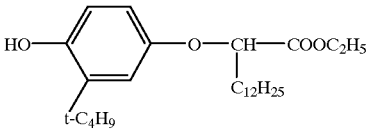

Processing:

The samples were subsequently exposed for 40 ms behind a step wedge and were processed as follows, using process AP 94:

a) Colour developer—45 sec. −35° C.

| | |
|---|---|
| triethanolamine | 9.0 g |
| N,N-diethylhydroxylamine | 4.0 g |
| diethylene glycol | 0.05 g |
| 3-methyl-4-amino-N-ethyl-N-methanesulphonamidoethyl aniline sulphate | 5.0 g |
| potassium sulphite | 0.2 g |
| triethylene glycol | 0.05 g |
| potassium carbonate | 22 g |
| potassium hydroxide | 0.4 g |
| ethylenediaminetetraacetic acid, disodium salt | 2.2 g |
| potassium chloride | 2.5 g |

-continued

| | |
|---|---|
| 1,2-dihydroxybenzene-3,4,6,-trisulphonic acid, trisodium salt | 0.3 g |
| made up with water to 1000 ml; pH 10.0 | |

b) Bleach-fixing—45 sec. −35° C.

| | |
|---|---|
| ammonium thiosulphate | 76 g |
| sodium hydrogen sulphate | 13.5 g |
| ammonium acetate | 2.0 g |
| ethylenediaminetetraacetic acid (iron ammonium salt) | 57 g |
| 25% ammonia | 9.5 g |
| made up with acetic acid to 1000 l; pH 5.5 | |

c) Washing—2 min. −33° C.

d) Drying

Layer structure 2

As for layer structure 1, except that blue-sensitive emulsion A1 in layer 2 was replaced by A2.

Layer structure 3

As for layer structure 1, except that blue-sensitive emulsion A1 in layer 2 was replaced by A3.

Layer structure 4

As for layer structure 1, except that blue-sensitive emulsion A1 in layer 2 was replaced by A4.

Layer structure 5

As for layer structure 4, except that layer 4 had the following composition:

A green-sensitised silver halide emulsion layer B-1 comprising 0.20 g $AgNO_3$ with

| | |
|---|---|
| 1.13 g | gelatine |
| 0.13 g | magenta coupler PP-2 |
| 0.05 g | magenta coupler M-6 |
| 0.05 g | magenta coupler M-13 |
| 0.20 g | dye stabiliser ST-3 |
| 0.15 g | dye stabiliser ST-4 |
| 0.46 g | coupler solvent K-3. |

The blue-sensitivity log I.t×10 ($E_b$), the green-sensitivity log I.t×10 ($\Delta E_g$) and the res-sensitivity log I.t×10 ($\Delta E_r$) were each determined at density 1.0, and the sensitivity difference Δlog I.t×1000 for blue ($\Delta E_b$), green ($\Delta E_g$), and red light ($\Delta E_r$) was determined from the sensitivity on processing 24 hours after exposure minus the sensitivity on processing 60 seconds after exposure, at a density of 0.6 in each case. The lower the value of the sensitivity difference, the better is the latent image stability.

| Layer structure | $E_b$ (log I · tx10) | $E_g$ (log I · tx10) | $E_r$ (log I · tx10) | $\Delta E_b$ (Δlog I · tx1000) | $\Delta E_g$ (Δlog I · tx1000) | $\Delta E_r$ (Δlog I · tx1000) | Remarks |
|---|---|---|---|---|---|---|---|
| 1 | 14,0 | 14,5 | 14,9 | 25 | 15 | 6 | Comparison |
| 2 | 14,4 | 14,6 | 15,1 | 34 | 16 | 8 | Comparison |
| 3 | 14,2 | 14,5 | 15,0 | 5 | 14 | 6 | Comparison |
| 4 | 15,0 | 14,8 | 15,2 | 7 | 13 | 5 | Invention |
| 5 | 14,7 | 14,8 | 15,1 | 6 | 11 | 4 | Invention |

The blue-sensitive silver halide emulsion A4 of layer structures 4 and 5, which was sensitised with I-1 and doped with mercury, exhibited a significantly higher sensitivity and a significantly improved latent image stability.

Compounds used for the first time in layer structure 5:

PP-2

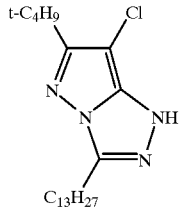

ST-3

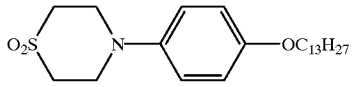

ST-4

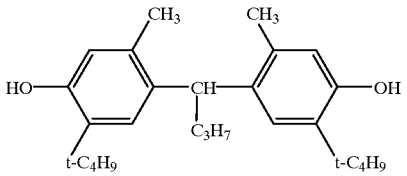

K-3 $O{=}P[OCH_2CH(CH_2CH_3){-}(CH_2)_3CH_3]_3$

We claim:

1. A color photographic silver halide material comprising at least one blue sensitive silver halide emulsion layer containing at least one yellow coupler, at least one green-sensitive silver halide emulsion layer containing at least one magenta coupler, and at least one red-sensitive silver halide emulsion layer containing at least one cyan coupler, and at least one of the blue-sensitive silver halide emulsions is doped with mercury and is spectrally sensitized with a sensitizing dye of formula (I)

(I)

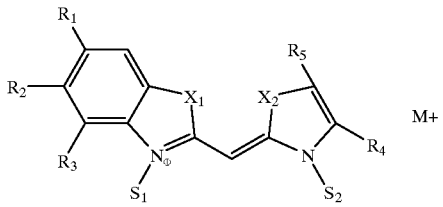

wherein $X_1$ and $X_2$, independently of each other, denote O, S, Se or NR,

R denotes alkyl or carboxyalkyl, $R_1$ and $R_2$ or $R_2$ and $R_3$ denote the remaining members for the completion of a phenanthro- or anthraazole ring, and the remaining $R_1$ or $R_3$ radical denotes a hydrogen atom, $R_4$ and $R_5$, independently of each other, denote a hydrogen atom, alkyl or aryl, or $R_4$ and $R_5$ jointly denote the remaining members of an unsubstituted or substituted benzazole, naphthazole, phenanthro-or anthraazole, $S_1$ and $S_2$, independently of each other, denote alkyl, sulphoalkyl or carboxyalkyl, and $M^+$ denotes a cation which is possibly necessary for charge equilization.

2. The color photographic silver halide material according to claim 1, wherein the silver halide emulsions thereof consist of at least 95 mole % AgCl.

3. The color photographic silver halide material according to claim 1, wherein said at least one yellow coupler corresponds to formula II (II)

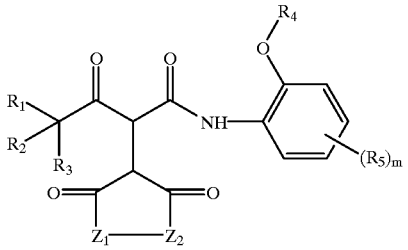

in which $R_1$, $R_2$, $R_3$, independently of each other, denote alkyl, or $R_2$ and $R_3$ jointly form a three-to six-membered ring;

$R_4$ denotes alkyl, cycloalkyl or aryl;

$R_5$ denotes halogen, alkyl, alkoxy, aryloxy, carbamoyl, sulphamoyl, alkoxycarbonyl, alkylsulphonyl;

m is 0, 1, 2or 3;

$Z_1$ denotes —O— or —$NR_6$—;

$Z_2$ denotes —$NR_7$— or —$C(R_8)R_9$—; and $R_6$, $R_7$, $R_8$ and $R_9$, independently of each other, denote hydrogen or a substituent.

4. The color photographic silver halide material according to claim 1, wherein the water-soluble salts of mercury of formula (III) or (IV) are used for doping with mercury $Hg(X_1)_2$ (III), $Hg(X_2)$ (IV), wherein $X_1$ denotes a monovalent anion and $X_2$ denotes a divalent anion.

5. The color photographic silver halide material according to claim 4, wherein the mercury compound is used in an amount of 1.0 to 30 $\mu$moles/mole of the respective silver halide.

6. The color photographic recording material according to claim 1, wherein said at least one magenta coupler corresponds to formula V (V)

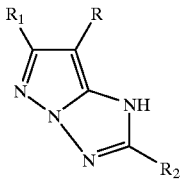

wherein

R denotes H or a group which is split off under the conditions of chromogenic development, $R_1$ denotes alkyl, which is optionally substituted, and $R_2$denotes $R_1$ or aryl, wherein the sum of all the C atoms of the $R_1$ and $R_2$ radicals in a coupler molecule is at least 12.

* * * * *

UNITED STATES PATENT AND TRADEMARK OFFICE

CERTIFICATE OF CORRECTION

PATENT : 6,063,557

DATED : May 16, 2000

INVENTOR(S) : Cuong Ly, Maria Nietgen, Michael Missfeldt, Heinz-Horst Teitscheid, Edgar Draber and Markus Geiger It is certified that error appears in the above-identified patent and that said Letters Patent is hereby corrected as shown below:

In claim 3, column 44, line 6, in the definition of "m" there should be a space between the "2" and the word "or".

Signed and Sealed this

Twentieth Day of March, 2001

Nicholas P. Godici

*Attest:*

NICHOLAS P. GODICI

*Attesting Officer*

*Acting Director of the United States Patent and Trademark Office*